United States Patent [19]

Fischer et al.

[11] 4,149,467

[45] Apr. 17, 1979

[54] ADJUSTABLE TIME FUSE

[75] Inventors: Klaus-Heinz Fischer, Troisdorf; Hans-Joachim Eickmann, Wermelskirchen, both of Fed. Rep. of Germany

[73] Assignee: Dynamit Nobel Aktiengesellschaft, Fed. Rep. of Germany

[21] Appl. No.: 288,394

[22] Filed: Sep. 12, 1972

[51] Int. Cl.[2] ..... F42C 11/06

[52] U.S. Cl. ..... 102/207

[58] Field of Search ..... 102/70.2, 207

[56] References Cited

U.S. PATENT DOCUMENTS

| | | | |
|---|---|---|---|
| 2,896,095 | 7/1959 | Reed, Jr. et al. | 307/149 |
| 3,065,365 | 11/1962 | Hurd et al. | 310/2 |
| 3,548,749 | 12/1970 | Dreitzler | 102/70.2 R |
| 3,690,259 | 9/1972 | Piazza | 102/70.2 R |

*Primary Examiner*—Charles T. Jordan

*Attorney, Agent, or Firm*—Craig & Antonelli

[57] ABSTRACT

An adjustable time fuse includes an electrolytic cell with the anode and cathode connectible in two circuits with opposite polarity and a battery connected in the circuits. One of the circuits causes an element of the electrolyte to be deposited on one of the electrodes to activate the cell and the other causes the same element to be removed from the electrode. When this element is completely removed, the internal resistance of the cell increases rapidly. This increase in resistance triggers a thyristor to allow a condenser to discharge through a primer to produce the desired action.

16 Claims, 2 Drawing Figures

ADJUSTABLE TIME FUSE

BACKGROUND OF THE INVENTION

1. Field of the Invention

The invention relates to a programmable time fuse, which utilizes a reversible electrochemical process with definite beginning and end states in order to operate the igniting device after a predetermined time by an electronic or electromechancial switch.

2. The Prior Art

In the field of military usage, there is frequently needed a time fuse which is adjustable continuously or discontinuously over a wide time range. The present invention provides such an arrangement.

Delay times in time fuses have heretofore been achieved by the following principles: through mechanical clocks, pyrotechnical and chemical delay arrangements, through the use of analog procedures as well as by the use of an oscillator with a frequency divider. Time fuses based on these principles are not always applicable because of their construction. With mechanical clocks a time range less than 0.1 seconds cannot be achieved. Also the clockwork can easily be detected because of its ticking.

Pyrotechnic and chemical time fuses are feasible only for time delays up to a few seconds and do not have sufficient accuracy for many uses. Electronic time fuses with an oscillator and a frequency divider are indeed very exact, but their production is very complicated and therefore expensive.

SUMMARY OF THE INVENTION

The purpose of the present invention is to provide a programmable time fuse which because of its nature is universally adjustable. It is especially desirable that a time fuse be storable for long periods of time, operate completely silently, have a small content of metal and be capable of being programmed for a time range of a few seconds to several months.

The invention is a programmable time fuse, which has several electric circuits, perferably three. The first is a time circuit for programming the time base, consisting of an arrangement in which an electrochemical process can take place and which during programming is connected over a resistance in series with a source of current. The second is a time circuit with a programmable time base consisting of an arrangement for the reversible electrochemical process, which is connected over a resistance with a direct current source and an electronic switch. The third is a fuse circuit, by which the primer of the fuse is connected over the electronic switch with a current source. These time fuses have, with a current source common to all the circuits, a time delay $$t_1 = R_1/R_2 \cdot t_2$$

where $t_2$ is the time during which a current flows in the time circuit for programming the time base and $R_1$ and $R_2$ are the resistances in the first and second circuit respectively.

DESCRIPTION OF THE PREFERRED EMBODIMENTS

Figure 1:
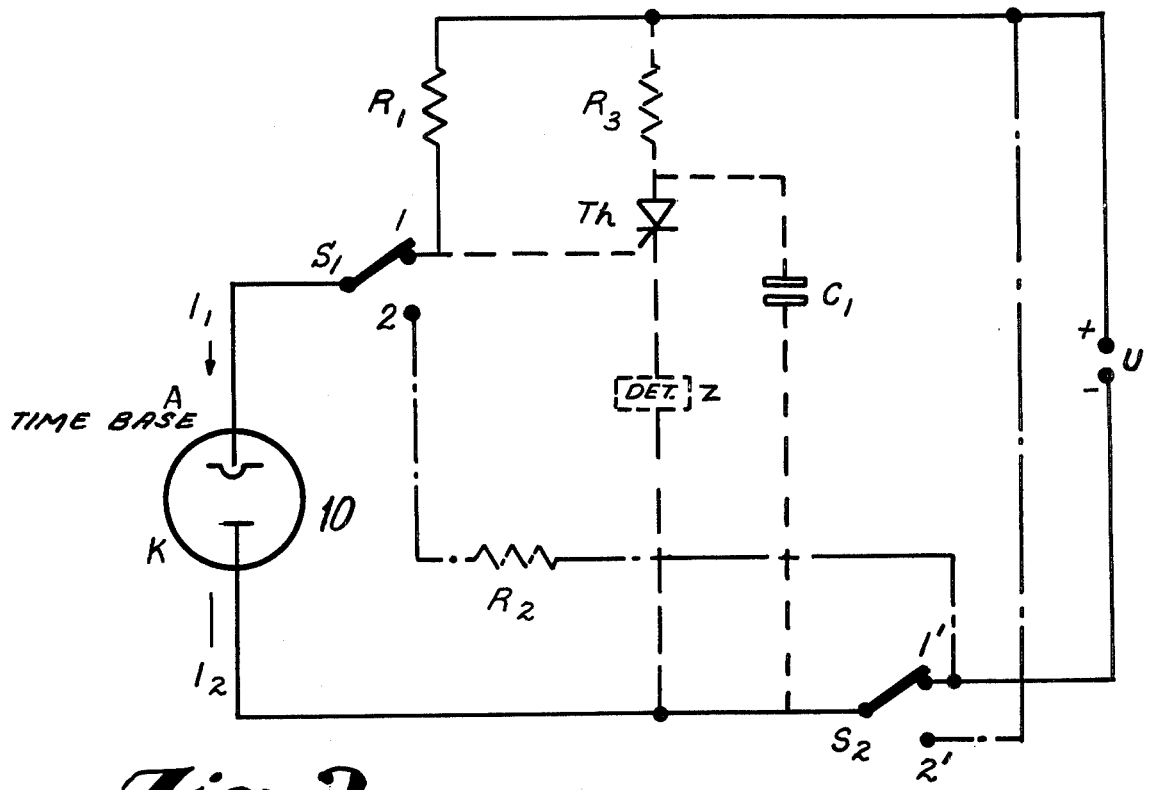
FIG. 1 shows diagrammatically a time fuse embodying the invention.

In the time fuse shown in FIG. 1, the time circuit for programming the time base is shown in dot and dash lines. The arrangement in which an electrochemical process can take place may be an electrochemical cell 10. Such cells are shown, for example, in U.S. Pat. Nos. 2,744,217; 3,423,642; 3,423,643; 3,423,644 and 3,423,648. The operation of these cells is such that a conductive material deposited on an electrode is removed by the current flow. During this process the internal resistance of the cell is small (a few ohms). This process is ended when the conductive material is completely deposited on the counter-electrode. Thereupon the internal resistance of the cell increases quite sharply.

The time circuit for programming the time base, which can be designated as the "charging circuit", consists essentially of the cell 10, the resistance $R_2$ and the current source U. At the beginning there is no conductive material on the anode A of the cell 10. The programming of the cell consists in depositing a definite quantity Q of conductive material on the anode A. This procedure is determined by the current intensity $I_2$, which is flowing during a predetermined time, by the formula:

$$Q = I_2 \cdot t_2$$

The time circuit with a programmable time base, which corresponds to the charging circuit can be designated as the "discharging circuit" is shown in FIG. 1 in solid lines. This discharging circuit consists of the cell 10, on the anode of which a definite quantity Q of conductive material is deposited, and the current source U.

The removal of material from the anode is determined by the current intensity I, according to the formula $$t_1 = Q : I_1$$

The supply of current to the two time circuits can be from a common current source U. In this case it is practical to include in the device two switches $S_1$ and $S_2$, which accomplish a polarization of the potential exerted on the cell 10 and connect the anode of the cell 10 either over the resistance $R_1$ with the positive pole or over the resistance $R_2$ with the negative pole of the current source, with the closing of the contacts 1 and 1' of the switches $S_1$ and $S_2$ the discharging circuit is closed, and with the closing of contacts 2 and 2' the charging circuit is closed.

The fuse circuit, which is shown in broken line in FIG. 1, includes a controllable electronic switch Th, the primer Z and a current source. The supply of current to the fuse circuit can be produced in various ways. As FIG. 1 shows, the fuse circuit can include the current source U, in which case an accumulator in the form of a condenser $C_1$ with a charging resistance $R_3$ is used. But a separate source of current or an independently charged accumulator can also be used for this circuit.

The mode of operation of the time fuse diagrammatically shown in FIG. 1 is now to be explained; for simplicity there is shown a common current source consisting of a 3-volt battery.

With the switches $S_1$ and $S_2$ in contact with the terminals 2 and 2' the cell 10 is connected over resistance $R_2$ to the current source U. Thereby the anode A of the cell 10 is coated with a layer of conductive material of a quantity $Q = I_2 \cdot t_2$, where $I_2$ is the current intensity and $t_2$ the time of current flow.

After the end of the desired deposition, the switch $S_1$ is moved to close its contact 1, so that the cell 10 and the whole fuse circuit are disconnected from the current source. The conductivity of the now programmed fuse circuit is determined only by the battery.

The discharging action of the discharging circuit is initiated by moving switch $S_2$ to close its contact 1'. The cell 10 is now connected over the resistance $R_1$ to the current source U. Simultaneously the condenser $C_1'$ is charged over the resistance $R_3$. The current $I_1$ removes the material from the anode of programmed cell 10. The discharge time is determined by the formula $$t_1 = Q : I_1$$

where the quantity Q of the conductive material is determined by the programming.

There follows according to Ohm's law a delay time:

$$t_1 = R_1/R_2 \cdot t_2$$

The delay time is then, taking into account the resistances $R_1$ and $R_2$, proportional to the charging time $t_2$.

At the conclusion of the removal process, the cell 1 is subjected to a sudden increase in voltage which triggers the electronic switch Th and thus closes the firing or fuse circuit.

It is advantageous to use a thyristor as the electronic switch, which is triggered by the increase of voltage on the cell 10. But instead of a thyristor other electronic or electro-mechanical switches can be used.

During the charging period both plates of the condenser $C_1$ are connected with the positive pole of the current source, so that the condenser cannot be charged. On the other hand, the condenser is charged during the discharging period over the resistance $R_3$. When the thyristor Th is triggered, the whole of the electric energy stored by the condenser $C_1$ is fed to the primer Z and produces the ignition.

If for example a time fuse made according to the diagram of FIG. 1 is made with a 3-volt battery as the current source, which is used for time delay $t_1$ greater than 45 seconds, the following elements can be used:

Electrochemical cell: 1,500 μAh
Resistance $R_1$: 30 kOhm
Resistance $R_2$: 3 kOhm
Resistance $R_3$: 15 kOhm
Condenser $C_1$ : 1,000 μuF
Thyristor C 106 F1 (General Electric)
Primer PX 20 (internal resistance = 20 Ohm)

The minimum time delay achievable depends on the resistance $R_3$, because the resistance $R_3$ determines the time required to charge the condenser $C_1$. In the above example, the fuse time delay is 10 times greater than the charging time, because resistances are used having the relation: $R_1 : R_2 = 10:1$.

In using an ordinary battery, a cutoff switch arrangement is used, this is shown in FIG. 1 by the switch positions $S_1$1, $S_2$2'. The shelf life of the time fuse is limited by that of the battery. Therefore it is desirable to use activatable batteries, which like the electrochemical cells have a guaranteed shelf life of 10 years. The activation of the battery takes place just before the charging of the fuse.

A condenser can be used as the current source. This arrangement can be used only for shorter delay periods, because a condenser, on account of its unavoidable leakage current, is unsuitable as a current source for longer times.

If a condenser is used as a current source for the circuit shown in FIG. 1 it is necessary to connect in a spark diode with high internal resistance in front of the resistance $R_3$, so that a discharge of the electric energy from the condenser used as a current source over the condenser $C_1$ does not take place simultaneously with the removal of the conductive material from the anode A of the cell 10. Another possibility is the separation of the firing circuit, so that the condenser C is independently charged or another current source, such as a battery, must be included.

The condenser $C_1$, which causes the setting off of the primer Z, is practically essential in using time fuses at low temperatures, because under those conditions a battery serving as a current source loses its charge. Chemical reactions of course takes place more slowly at lower temperatures, so that then a battery used as a current source is no longer so conductive. Besides an additional load should be avoided.

It is also possible to construct the electrochemical cell in a programmed condition, by using a cell whose anode already during its manufacture has a predetermined quantity of conductive material appled on it. In using air activatable battery, no switch is then required. The fuse time delay can then always be varied by an adjustable resistance $R_1$.

The electrochemical process which produces the time base is naturally temperature-dependent. The temperature coefficient of the cell has negative characteristics, that is, with increasing temperature the process is accelerated. This characteristic of the cell would lead, without corresponding compensation of the temperature cycle, to a dependence of the time delay on the ambient temperature.

Figure 2:
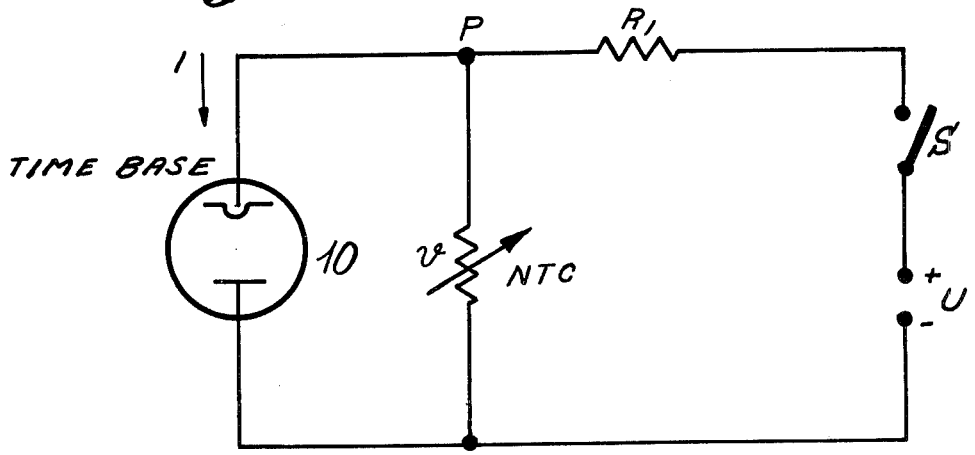
FIG. 2 shows a simplified form of time fuse.

To compensate for this temperature-dependence, there serve for the current-determining resistances $R_1$ and $R_2$ resistances with positive temperature coefficients (PTC-resistances). The resistance-temperature charts of these resistances must follow the same course with reversed characteristics as the resistance characteristic of the cell 10. The temperature compensation is however simpler with the use of a voltage divider, as is shown in FIG. 2, which can be formed of a normal resistance and a resistance with a negative temperature-characteristic (NTC-resistance). The NTC-resistance is cheaper and its manufacture presents less problems than a PTC-resistance.

With increasing temperature the electrochemical process in the cell is accelerated. Because the NTC-resistance however is smaller in the same proportion, the current at the point P (FIG. 2) is reduced. The discharge current is reduced in this way.

The temperature stability can also be obtained by a resistance network of NTC-, PTC- and normal resistors or a current-stabilized current source for compensation of temperature changes in the electrochemical cell.

Instead of an electrochemical cell, primarily for long fuse time delays, a rechargeable battery can be used, in which of course a reversible electrochemical process takes place.

By this simple and inexpensive time fuse it is possible to produce very exact fuse time delays over a great time range. Besides the time fuse can be stored for long periods, is temperature-stable and possesses the necessary consistent of acceleration which is necessary for many purposes.

We claim:

1. A time fuse comprising an electrochemical device in which a reversible chemical reaction takes place and in which one end point of such reaction produces a sudden change in the internal resistance of the device, means connectible to the device to cause the reaction to progress towards such end point, primer means, and means connecting the device to said primer means and responsive to such sudden change of resistance to activate the primer means.

2. A time fuse as claimed in claim 1, in which said device is an electrolytic cell having a conducting material on one electrode thereof, and said end point is the removal of the conductive material from such electrode.

3. A time fuse as claimed in claim 2, in which said progress causing means includes a source of current and a resistance between the source of current and the cell.

4. A time fuse as claimed in claim 2, which includes means connectible to the cell to deposit said conductive material on the electrode.

5. A time fuse as claimed in claim 1, in which said primer actuating means includes a thyristor and a resistance connecting said primer means to a current source.

6. A time fuse as claimed in claim 5, in which the means to actuate the primer means includes a condenser connected to said thyristor and chargeable by said current source.

7. A time fuse as claimed in claim 5, having a resistance connected between the current source and the condenser.

8. A time fuse as claimed in claim 1, in which the electrochemical device is a rechargeable battery.

9. A time fuse comprising an electrochemical device in which a reversible chemical reaction takes place and in which one end point of the reaction produces a sudden change in the internal resistance of the device, first circuit means to supply current to the device to cause said reaction to progress towards such end point, primer means, second circuit means to supply current to such primer means, and means in said second circuit means responsive to such sudden change of resistance to render said second circuit means operative to activate the primer means.

10. A time fuse as claimed in claim 9, in which said first and second circuit means include a common source of current.

11. A time fuse as claimed in claim 9, including third current means to supply current to said device in a reverse direction to the current supplied by the first circuit means, and means for selectively closing said first and third circuits.

12. A time fuse as claimed in claim 11, which includes resistance means in said first circuit means, said resistance means having a temperature-responsive characteristic compensating for the effect of temperature variations on said device.

13. A time fuse as claimed in claim 12, in which said device is an electrolytic cell and said resistance means has a positive temperature characteristic.

14. A time fuse as claimed in claim 12, in which said device is an electrolytic cell and said resistance means includes a resistance with a negative temperature characteristic connected in parallel with said cell.

15. A time fuse as claimed in claim 12, in which said device is an electrolytic cell and said first circuit includes a temperature-stabilized current source.

16. A time fuse as claimed in claim 11, in which said first, second and third circuit means include a common source of current.

* * * * *